United States Patent [19]

Bachmann et al.

[11] 4,159,725

[45] Jul. 3, 1979

[54] APPARATUS FOR TENSIONING AND LOCKING HOOPING BANDS

[75] Inventors: Hans Bachmann, Fahrweid; Ernst Albiez, Widen, both of Switzerland

[73] Assignee: Borbe-Wanner AG., Switzerland

[21] Appl. No.: 855,190

[22] Filed: Nov. 28, 1977

[30] Foreign Application Priority Data

Dec. 3, 1976 [CH] Switzerland ..... 15274/76

[51] Int. Cl.[2] ..... B21F 9/02

[52] U.S. Cl. ..... 140/93.2

[58] Field of Search ..... 140/93.2, 93.4; 100/29, 100/30, 32, 33 R

[56] References Cited

U.S. PATENT DOCUMENTS

| | | | |
|---|---|---|---|
| 3,506,041 | 4/1970 | Angarola | 140/93.4 |
| 3,863,684 | 2/1975 | Simmons | 140/93.4 |
| 3,929,172 | 12/1975 | Sansum | 140/93.2 |

*Primary Examiner*—Lowell A. Larson

*Attorney, Agent, or Firm*—Roylance, Abrams, Berdo & Farley

[57] ABSTRACT

The apparatus is of the type having a tensioning roller, a motor drive for rotating the roller in the direction of the band to tension the hooping band, and a locking device which may be raised or lowered by a thrust drive guided in a casing to press against the portions of the band to lock them together.

The improvement comprises a control member associated with the motor drive of the tensioning roller. The position of the control member is determined on the one hand by a reaction force proportional to the tangential force exerted on the tensioning roller, and on the other hand by an opposing force acting on the control member. When the band tension exceeds a particular value, the motor drive of the roller is switched off by the control member and the thrust drive of the locking device is switched on.

8 Claims, 7 Drawing Figures

APPARATUS FOR TENSIONING AND LOCKING HOOPING BANDS

BACKGROUND OF THE INVENTION

The invention relates to an apparatus for tensioning and locking band hoops on packages by permanent deformation of two superimposed portions of a flexible hooping band or strap. The tensioning of the hooping band is brought about by pressing a raisable and lowerable tensioning roller onto the portions and by rotating the same in the tensioning direction of the hooping band by means of a motor drive. The locking of the hooping band is brought about by a raisable and lowerable locking device guided in a casing and pressed onto the portions by a thrust drive. In the present context the term "package" is understood to mean all types of bales, bundles, cases, packets and the like.

Various constructions of apparatus for tensioning and locking band hoops are known, and all of them have a tensioning part and a locking part, cf. e.g. U.S. Pat. Nos. 3,346,023, 3,323,608 and 2,813,411. Prior to the start of the locking process, the tensioning part is used to tension the hooping band placed around the package to such an extent that the band hoops fits tightly round the package. After tensioning of the hooping band, the locking part produces the actual band hoop by joining the superimposed band portions. The latter are deformed either with or without a locking sleeve in order to obtain a permanent connection.

Thus, for producing a band hoop the tensioning part and the locking part cooperate, i.e. the tensioning of the hooping band to a certain level must be terminated before the locking process starts. In this connection, it is important that the tensioning part produces and maintains a constant band tension on the hooping band and the article packed until the locking part has completed the deformation operation on the two superimposed band portions.

SUMMARY OF THE INVENTION

In accordance with the present invention, there is constructed an apparatus for tensioning and locking band hoops which is such that a predetermined band tension is automatically maintained and that the locking operation can only be started when the band hoop has reached the set tension. The apparatus includes, in association with the motor drive of the tensioning roller, a sensor which is subject on the one hand to the action of a force on the tensioning roller, proportional to the tension exerted, and on the other hand to a predetermined opposing force acting on the sensor. At a predetermined tension, the sensor action switches off the motor drive of the tensioning roller.

DESCRIPTION OF THE PREFERRED EMBODIMENTS

Figure 1:
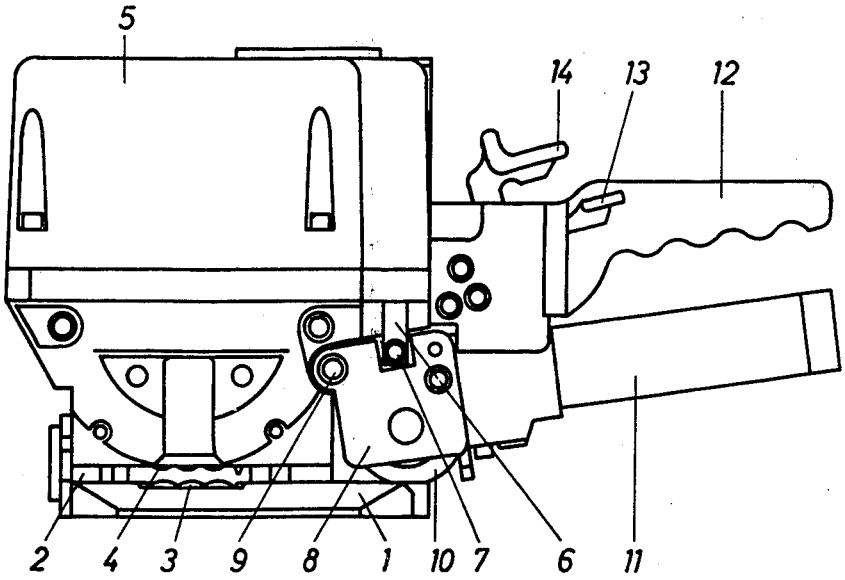
FIG. 1 is a side view of an apparatus for tensioning and locking band hoops.

The apparatus shown in FIG. 1 for tensioning and locking band hoops has a base plate 1, above which is arranged a band channel 2 accessible from one side for inserting the not shown superimposed band portions of a hooping band. In the base plate 1 is mounted a punch 3 facing a locking device 4 in the form of a die fixed to a primary thrust drive. The punch 3 and locking device 4 have their pressing surfaces shaped in such a way that on pressing down the locking device against the superimposed band portions of the hooping band these portions are shaped into a permanent connection.

In another embodiment, not shown, the punch 3 in base plate 1 can be replaced e.g. by a recess into which is lowered to a tong-like locking device fixed to a primary thrust drive in order to shape the superimposed band portions into a permanent connection, such as is described in the above-cited U.S. Pat. No. 2,813,441.

Above band channel 2 there is arranged a casing 5 connected to the base plate 1 and in which is fitted the primary thrust drive for the locking device 4. Alongside the latter primary thrust drive is placed a secondary thrust drive having a thrust rod 6 articulated via a swivel joint 7 to a tensioning housing 8 which is in turn mounted by means of a swivel joint 9 on casing 5. The tensioning housing 8 can therefore be pivoted about the swivel joint 9 by means of the associated secondary thrust drive via the thrust rod 6.

A tensioning roller 10 which, as will be described in greater detail hereinafter, is driven by a motor drive 11, e.g. a fluid motor, is pivotably mounted in the tensioning housing 8. For inserting the hooping band in the band channel 2 the tensioning housing 8 with the tensioning roller 10 is raised and lowered with the associated secondary thrust drive and thrust rod 6. When the hooping band is inserted, the tensioning housing 8 is lowered and the tensioning roller 10 is pressed onto the hooping band and rotated for tensioning.

Fixed to the casing 5 is a handle 12, on which are provided two operating levers 13, 14 which will be described in conjunction with FIG. 2.

Figure 2:
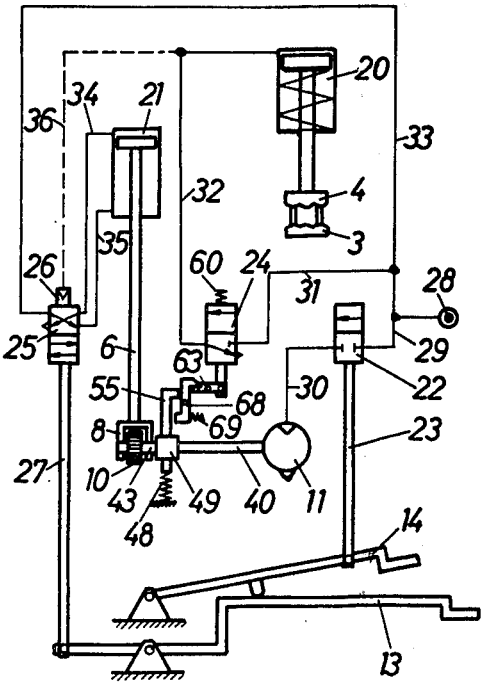
FIG. 2 is a partly schematic circuit diagram of the apparatus of FIG. 1.

In the circuit diagram of FIG. 2, parts corresponding to those of FIG. 1. are given the same reference numerals. As can be seen from the circuit diagram, the apparatus of FIG. 1 has three power drives; namely a motor drive 11 in the form of a fluid motor, particularly a pneumatic motor; a primary thrust drive 20 for the locking device 4 in the form of a single-acting thrust piston drive with spring return; and, a secondary thrust drive 21 in the form of a double-acting thrust piston drive for raising and lowering the tension roller 10. A control valve is associated with each of the three power drives 11, 20, 21. Specifically, for the motor drive 11 there is a 2/2-way valve 22 operable by operating lever 14 via a rod 23; for the primary thrust drive 20 there is a 3/2-way valve 24 with an outlet to the atmosphere having a return spring and mechanical actuation; and, for the secondary thrust drive 21 there is a 4/2-way valve 25 with fluid-actuated anticipatory control 26 and with a mechanical actuation by a rod 27 connected to operating lever 13.

A fluid pressure source 28 supplies the fluid flow energy necessary for drives 11, 20, 21 via lines 29/30, 31/32 and 33/34/35. Pressure is applied to anticipatory control 26 by means of a control line 36.

A special type of mechanical connection which will be described relative to FIGS. 3 to 7 is provided between the motor drive 11 of tensioning roller 10 and the valve 24 for the primary thrust drive 20 of the locking device 4.

Figure 3:
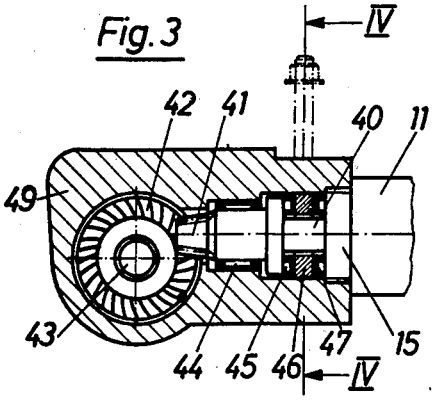
FIG. 3 is a section through part of the motor drive of the tensioning roller of the apparatus of FIG. 1.

FIG. 3 shows that to the driving shaft 40 of motor drive 11 there is fixed a pinion 41 of a bevel gearing, e.g. with spiral bevel gears, whose plate 42 is fixed to a shaft 43 of the tensioning roller 10. The bevel gearing 41, 42 could also be replaced by another mitre gear. While the radial forces on pinion 41 are absorbed by a radial roller bearing 44, the axial forces are absorbed by a first axial roller bearing 45 which is supported via a plate cam 46 (FIGS. 4 and 5) on a second axial roller bearing 47, the latter being supported on a fixed housing part 15. Due to the axial force on pinion 41, a friction force proportional to the axial force on it is produced on the first roller bearing 45, and this rotates the plate cam 46 counter to the tension of a compression spring 48. The spring 48 is supported at one end against the housing part 49 and at the other against a spring plate 50 of a bolt 52 mounted in movable manner in a housing bore 51. Bolt 52 has a tooth 53 which engages in a slot 54 of plate cam 46, so that on rotation of the cam 46, bolt 52 is moved, and consequently the tension of spring 50 is changed.

Opposite the bolt 52 there is provided a control member constructed as a lifting rod 55 which is guided in movable manner in a housing bore 56 and has a tooth 57 which engages in a slot 58 of the plate cam 46. A further slot 59 in the cam 46 makes it possible, in the manner shown in FIG. 5, for there to be a non-jamming meshing of cam 46 and bolt 52.

Figure 5:
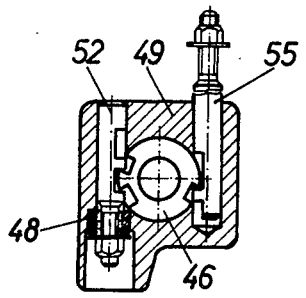
FIG. 5 is the same section as in FIG. 4, but with the opposing spring under tension and the sensor actuated.
Figure 6:
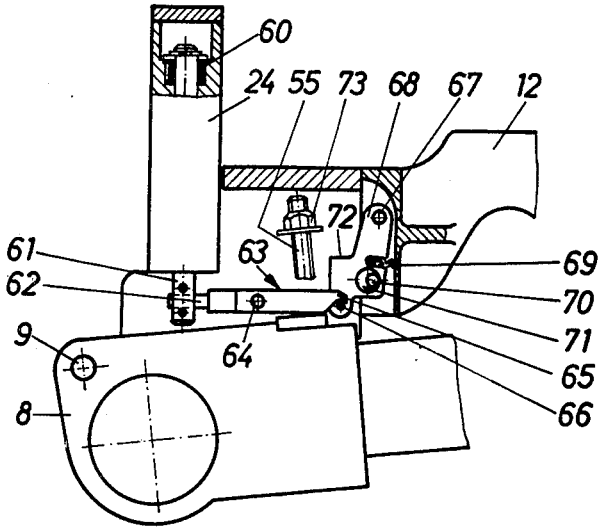
FIG. 6 is a partially exposed, partially sectioned view of a fragment of the apparatus of FIG. 1 showing a control valve for the thrust drive of the locking device in the pre-tensioned state.
Figure 7:
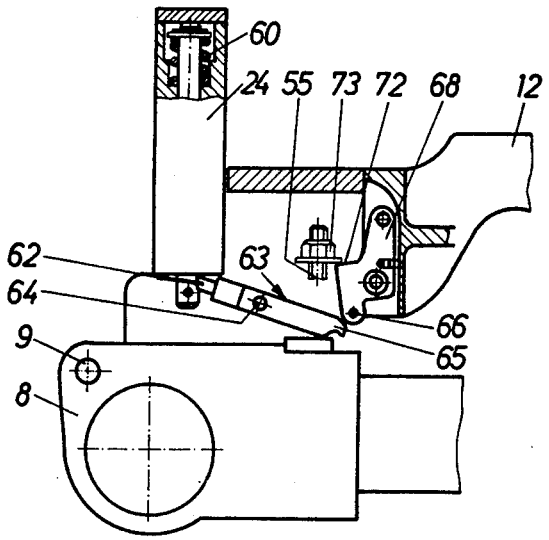
FIG. 7 is the same view as in FIG. 6, but with the released control valve for the thrust drive of the locking device.

FIG. 5 shows the position of the plate cam 46 with the opposing spring 48 under full tension. This position and that of the lifting rod 55 are obtained when a maximum axial force occurs on the pinion 41. FIGS. 6 and 7 show the interaction of the lifting rod 55 with the valve 24 for the primary thrust drive 20. The valve piston of valve 24 has on one side a return spring 60 and on the opposite side a fork 61 in which is guided one arm 62 of a two-armed lever 63 which is pivotable about a spindle 64. The other arm 65 of the lever 63 is supported on a bolt 66 of a catch 68 which is pivotable about a spindle 67. A compression spring 69 presses the catch 68 into the position shown in FIG. 6. A bolt fixed to the housing in the bore 71 limits the pivoting path of the catch 68.

In the position of the components as shown in FIG. 6 the band hoop is relaxed, whereas FIG. 7 shows the position in which the tensioning housing 8 is lowered and the not shown tensioning roller tensions the band hoop. In this way an axial force acts on the two roller bearings 45, 47 via pinion 41, causing a rotation of the plate cam 46 and consequently the lowering of lifting rod 55. If the end 73 of the lifting rod 55 strikes a shoulder 72 provided on the catch 68, the arm 65 of lever 63 is separated from bolt 66, so that the return spring 60 switches over the valve 26 and pressure is exerted on the primary thrust drive 20.

The interaction of all the components can best be seen from FIG. 2.

If, after insertion of the hooping band in band channel 2, the band hoop is to be locked, firstly the operating lever 13 is depressed, so that valve 25 is operated and pressure is exerted on lifting drive 21 via lines 33/34. By means of piston rod 6, lifting drive 21 lowers the tensioning housing 8 and presses the tensioning roller 10 onto the hooping band. Operating lever 14 is now operated so that valve 22 is operated and pressure acts on motor drive 11 via lines 29/30. As a result, tensioning roller 10 is rotated and places the band hoop under tension. The higher the tension exerted by the tensioning roller 10, the higher the axial force acting on pinion 41 mounted in housing 49 and, consequently, the frictional force which brings about the rotation of plate cam 46. Lifting rod 55, which exercises the function of a control member, moves counter to the tension of the spring until with end 73 it moves catch 68 and consequently breaks the connection between catch 68 and the two-armed lever 63. Due to the tension of return spring 60, valve 24 is operated so that pressure acts on lifting drive 20 via lines 31/32. As a result, the locking device 4 is pressed down onto the superimposed portions of the hooping band and the latter is locked. If pressure builds up in line 32, the anticipatory control 26 is operated via control line 36 and as a result the valve 25 is switched over again, so that pressure is applied to secondary thrust drive 21 by means of the line. As a result, pressure of tensioning roller 10 on the hooping band is removed and tensioning housing 8 is raised into the position of FIG. 6. Simultaneously, operating lever 13 is raised via rod 27, and as a result operating lever 14 which is supported on lever 13 is also raised. Consequently, valve 22 is operated and the pressure supply to motor drive 11 is interrupted. In the meantime, the locking operation is terminated.

Figure 4:
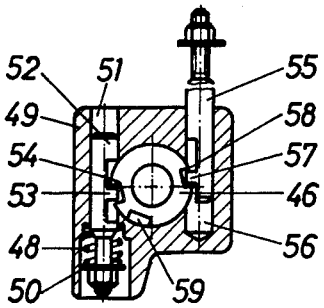
FIG. 4 is a section along the line IV—IV of FIG. 3 with the opposing spring of the sensor relaxed.

Since through the raising of the tensioning housing 8 and after switching off the motor drive 11 no axial force is exerted on the pinion 41, the lifting rod 55 under the action of spring 48 again assumes the position shown in FIG. 4. On raising the tensioning housing 8, the arm 65 of lever 63 is again placed on bolt 66 of catch 68 (FIG. 6), so that there is simultaneously an operating movement of valve 24 with the tensioning of return spring 60 and a switching of the line 32 to outflow, so that under the action of its return spring the primary thrust drive 20 raises the locking device 4. Thus, the device is again in its initial position and a further band hooping operation can take place.

The tension exerted on the hooping band depends on the one hand on the setting of opposing spring 48, and on the other on the position of the end 73 of lifting rod 55, as can be seen in FIGS. 4 and 5.

In the circuit diagram according to FIG. 2, certain diagrammatic simplifications have been made. Thus, the components necessary for operating the lifting rod 55 according to FIGS. 3 and 4 are represented in FIG. 2 solely by the housing 49 and the lifting rod 55 pressing directly onto the opposing spring 48. However, this is unimportant for understanding the control sequence. Levers 13 and 14 can also be replaced by a single lever for the simultaneous operation of valves 22 and 25. However, the described arrangement is particularly advantageous because it may be desired to initiate the pressing of the tensioning roller onto the hooping band on the one hand and the tensioning and locking on the other by separate operating levers 13, 14.

An important factor for the automatic tensioning and locking of the band hoop is the measurement of the tension exerted on the hooping band and the initiating of a lifting movement of lifting rod 55 for starting the locking operation. Therefore, the lifting rod 55 is a control member which responds to the tension exerted or to the resulting reaction force. In this connection, it is advantageous that the components which participate in the power transfer from motor drive 11 to tensioning roller 10 have to perform substantially no relative movement for exerting a reaction force. However, only relatively limited forces are available on the lifting rod 55. Therefore, valve 24 for the lifting drive 20 of locking device 4 is not directly operated by lifting rod 55, but instead with the aid of the return spring 60. Prior to operation, valve 24 with lever 63 is held in the pretensioned state on catch 68. After operation of the valve 24, this pretensioned state is restored with the raising of the tensioning housing 8.

We claim:

1. An apparatus for tensioning a strap about a package and locking the strap by permanently deforming two superimposed portions thereof, comprising a tensioning roller;

first thrust drive means coupled to said tensioning roller for moving said tensioning roller toward and away from the superimposed portions;

motor drive means coupled to said tensioning roller for rotating the tensioning roller in a direction to tension the strap;

a locking device;

second thrust drive means coupled to said locking device for moving said locking device toward the superimposed portions to deform same and away from the superimposed portions; and control means operably coupled to said motor drive means and said second thrust means for deactivating said motor drive means and actuating said second thrust means to move said locking device toward the superimposed portions when the tension of the strap exceeds a predetermined value, said control means comprising a thrust rod, rotary cam means, coupled to said rod and said motor drive means, for rotating in response to a frictional force exerted thereon by said motor drive means and corresponding to the tangential force exerted on said tensioning roller for moving said rod in one direction, spring biasing means coupled to said rod for resiliently biasing said rod in a direction opposite to said one direction, and retaining lever means coupled to said second thrust means and to said rod for maintaining said locking device in a position away from the superimposed portions when said rod is in a first position and for permitting said locking device to move toward the superimposed portions when said rod is in a second position.

2. An apparatus according to claim 1, wherein said rotary cam means and said rod are coupled by a tooth system.

3. An apparatus according to claim 1, wherein said motor drive means is coupled to said tensioning roller by bevel gearing means, said bevel gearing means comprising a gear and axial bearing means for supporting said rotary cam means and said gear, and for rotating said rotary cam means by exerting the frictional force generated by the axial forces in said bevel gearing means on said rotary cam means.

4. An apparatus according to claim 1, wherein said motor drive means, first thrust drive means and second thrust drive means are operated by fluid pressure and each has a valve to control actuation thereof;

said valve of said second thrust drive means coupled to one end of said retaining lever means, the other end of said retaining lever means releasably coupled to a spring biased catch, said catch being operably coupled to said rod so that said rod disengages said catch from retaining lever means in said second position and permits said catch to be coupled to said retaining lever means in said first position.

5. An apparatus according to claim 4, wherein said valve of said first thrust drive means is coupled to and operated by a first operating lever; means operably coupling said first and said second thrust drive means for conducting fluid pressure from said second thrust drive means to said first thrust drive means to move said tensioning roller away from the superimposed portions.

6. An apparatus according to claim 5, wherein said valve of said motor drive means is coupled to and operated by a second operating lever, means operably coupling said first and second operating levers for moving said second operating lever to an off position upon movement of said first operating lever to an off position.

7. An apparatus for tensioning a strap about a package and locking the strap by permanently deforming two superimposed portions thereof, comprising a tensioning roller coupled to a first thrust drive means for moving said tensioning roller toward and away from the superimposed portions;

motor drive means coupled to said tensioning roller for rotating the tensioning roller in a direction to tension the strap;

a locking device coupled to a second thrust drive means for moving said locking device toward the superimposed portions to deform same and away from the superimposed portions; and control means operably coupled to said motor drive means and said second thrust drive means for deactivating said motor drive means and actuating said second thrust drive means to move said locking device toward the superimposed portions when the tension of the strap exceeds a predetermined value comprising, a thrust rod;

means for coupling said rod to said motor drive means to move said rod proportionally to the tangential force exerted on said tensioning roller, retaining lever means coupled to said second thrust drive means and to said rod for locking said locking device in a position away from the superimposed portions when said rod is in a first position and for permitting said locking device to move toward the superimposed portions when said rod is in a second position, one end of said retaining lever means is coupled to said second thrust drive means and the other end of said retaining lever means is releasably coupled to a movable catch, said catch being operably coupled to said rod so that said rod disengages said catch from said retaining lever in a first portion and permits said catch to be coupled to said retaining lever means in a second position.

8. An apparatus according to claim 7, wherein said second thrust drive means is operated by fluid pressure and has a valve to control actuation thereof, said valve has a spring biased movable part connected to said one end of said retaining lever means and arranged in said valve so that said movable part is held against its spring bias to prevent the flow of fluid pressure to said second thrust drive means when said retaining lever means is releasably coupled to said catch and that said movable part is permitted to be moved by its spring bias to permit the flow of fluid pressure to said second thrust drive means to move said locking device toward the superimposed portions when said retaining lever means is released from said catch.

* * * * *